US005220763A

United States Patent [19]

Armitage

[11] Patent Number: 5,220,763

[45] Date of Patent: Jun. 22, 1993

[54] TRIM FOR CHALKBOARDS AND TACKBOARDS

[75] Inventor: Dwight M. Armitage, Indianapolis, Ind.

[73] Assignee: Wilson-Partenheimer, Inc., Indianapolis, Ind.

[21] Appl. No.: 696,835

[22] Filed: May 7, 1991

[51] Int. Cl.[5] ..... E04C 3/00

[52] U.S. Cl. ..... 52/461; 52/718.01; 434/421

[58] Field of Search ..... 52/717.1, 718.1, 461, 52/718.01; 40/152.1, 155, 158.1; 248/488, 487; 434/408, 421, 423

[56] References Cited

U.S. PATENT DOCUMENTS

| | | | |
|---|---|---|---|
| 2,073,278 | 3/1937 | Hohl | 189/88 |
| 2,651,852 | 9/1953 | Urbain | 35/63 |
| 2,947,093 | 8/1960 | Masters | 35/65 |
| 3,017,704 | 1/1962 | Masters | 35/63 |
| 3,038,571 | 6/1962 | Clements | 189/88 |
| 3,181,662 | 5/1965 | Maertzig, Jr. | 189/88 |
| 3,251,168 | 5/1966 | Waring et al. | 52/460 |
| 3,552,708 | 1/1971 | Hillstrom | 248/498 |
| 3,667,177 | 6/1972 | Biela | 52/278 |
| 4,078,326 | 3/1978 | Reim | 40/152.1 |
| 4,519,152 | 5/1985 | Seely et al. | 40/156 |
| 4,702,025 | 10/1987 | Mace | 40/156 |
| 4,936,065 | 6/1990 | Hutchinson | 52/235 |
| 4,949,483 | 8/1990 | Dobson et al. | 40/155 |

FOREIGN PATENT DOCUMENTS

| | | | |
|---|---|---|---|
| 0519890 | 3/1955 | Italy | 72/19 |
| 1398186 | 6/1975 | United Kingdom | 52/717.1 |

*Primary Examiner*—Carl D. Friedman
*Assistant Examiner*—Christopher T. Kent
*Attorney, Agent, or Firm*—Woodard, Emhardt, Naughton, Moriarty & McNett

[57] ABSTRACT

A trim mounting system for mounting display boards such as chalkboards, tackboards, dry marker boards and the like to a wall. The system includes a plurality of one-piece, extruded metal trim members and combination trim-mount/grounds each having lengths corresponding to the side dimensions of the display board. The trim members and trim-mount/grounds are provided with interlocking portions which extend continuously along their lengths, permitting simplified mounting of the trim members.

5 Claims, 6 Drawing Sheets

Prior Art

TRIM FOR CHALKBOARDS AND TACKBOARDS

BACKGROUND OF THE INVENTION 1. Field of the invention

The present invention relates to the trim or framing around wall mounted information display boards such as chalkboards, tackboards and dry marker boards and an improved method for installing the trim.

2. Description of the Prior Art

Wall mounted chalkboards, tackboards and dry marker boards are frequently used in classrooms to display information. Such boards exist in various sizes depending, for example, upon the size of the classroom. It is well known to provide a trim extending around the margins of the board. The trim serves at least several purposes. The trim, which is usually made of a durable material such as aluminum, serves to protect the margins of the board from being chipped or worn. Further, the trim serves as a decorative border framing board. In addition, the bottom trim portion associated with a chalkboard is provided with a tray for placement of chalk and erasers while the top trim portion of a chalkboard or tackboard is often provided with ears for holding maps or poster displays. Finally, the trim serves as a hold down means to mount the chalkboard or tackboard to the wall without having to directly mount the boards to the wall.

Present methods for installation of the trim involve the use of anchors, also known as grounds, which are bolted, screwed, or otherwise secured directly to a wall. The grounds are aligned at spaced intervals and each serves to receive a clip over which the trim segments are snapped into place. Because of the substantial labor involved in aligning and spacing grounds for mounting, continuous grounds have come into use. Continuous grounds extend the full length of the trim segment and have mounting holes for receiving the clips pre-drilled at the desired spacing intervals.

While continuous grounds save substantial labor time over use of the individual grounds, there are still disadvantages. For example, considerable time must still be spent mounting the clips onto the ground and adjusting the clips to have the proper alignment for trim mounting. Also, the snap-in mounting of the trim to the clips requires that the clips not be fastened too loosely or too tightly to the ground or additional adjustment will become necessary. In addition, when snapping on or removing trim from clips care must be taken not to apply force at the wrong location or too hard, otherwise the trim may be dimpled. Yet further, because clips may be moved when snapping in the trim, adjusting the trim miters to a proper fit can be difficult. Moreover, if clips are positioned over high spots along the wall the trim may not snap into place, or do so only with difficulty.

SUMMARY OF THE INVENTION

A trim mounting system for mounting display boards such as chalkboards, tackboards, dry marker board and the like to a wall, according to one aspect of the present invention, is characterized by a plurality of trim members and trim/mount grounds each having lengths corresponding to the side dimensions of a display board to be mounted. There is further provided a trim mounting means, associated with each of the trim members and trim-mount/grounds, for mounting the trim members directly to the trim-mount/grounds. The trim mounting means extends continuously along the length of the trim members and trim-mount/grounds.

In a further aspect of the invention, there is provided a method for installing informational display boards such as chalkboards, tackboards, dry marker boards and the like to a wall. The method is characterized by the steps of: (1) providing a plurality of trim members and trim-mount/grounds, each having lengths corresponding to the side dimensions of a display board to be mounted to a wall and having interlocking means for interlocking the trim members and trim-mount/grounds extending continuously along the length thereof, (2) fastening said trim-mount/grounds to the wall, (3) mounting the display board onto the wall in between said trim-mount/grounds, and (4) interlocking the trim members directly to the trim-mount/grounds so as to overlie the margins of the display board in abutting relationship with the display surface of the board.

In a yet further aspect, the present invention is characterized by a one-piece formed, metal trim-mount/-ground adapted for mounting informational display boards such as chalkboards, tackboards, dry marker boards and the like to a wall. The trim-mount/ground has a length corresponding to one of the side dimensions of the display board to be mounted. The trim-mount/-ground includes a trim mounting means for directly mounting the trim-mount/ground to a trim member and the trim mounting means extending continuously along the length of the trim-mount/ground.

Accordingly, it is an object of the present invention to provide an improved trim mounting system for mounting display boards such as chalkboards, tackboards, dry marker boards and the like to a wall.

It is a further object of the present invention to eliminate certain problems caused by the ground and clip trim mounting system by providing a single piece trim mounting member.

It is a further object of the present invention to provide an improved trim mounting system which lessens the time and skill necessary to produce a quality trim installation for display boards.

Related objects and advantages of the present invention will become more apparent by reference to the following figures and detailed description.

DESCRIPTION OF THE PREFERRED EMBODIMENT

Figure 1:
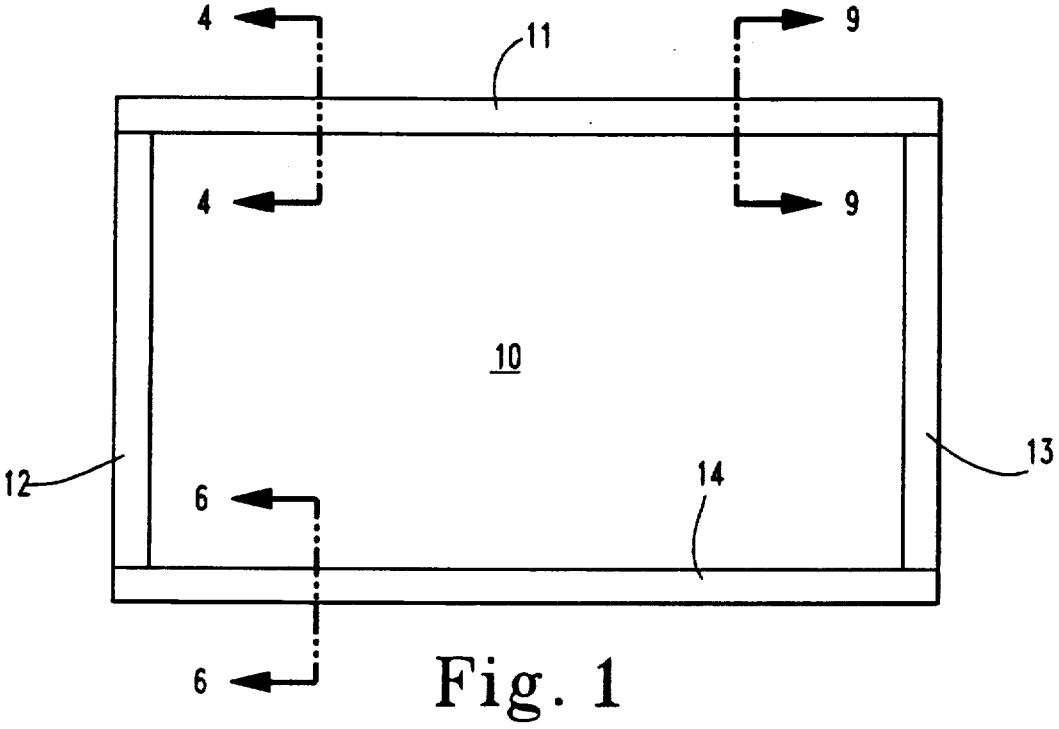
FIGS. 1-3 are front elevational views of a chalkboard, tackboard and combination chalk/tackboard, respectively, having trim borders of a type suitable for adaptation to the trim mounting system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
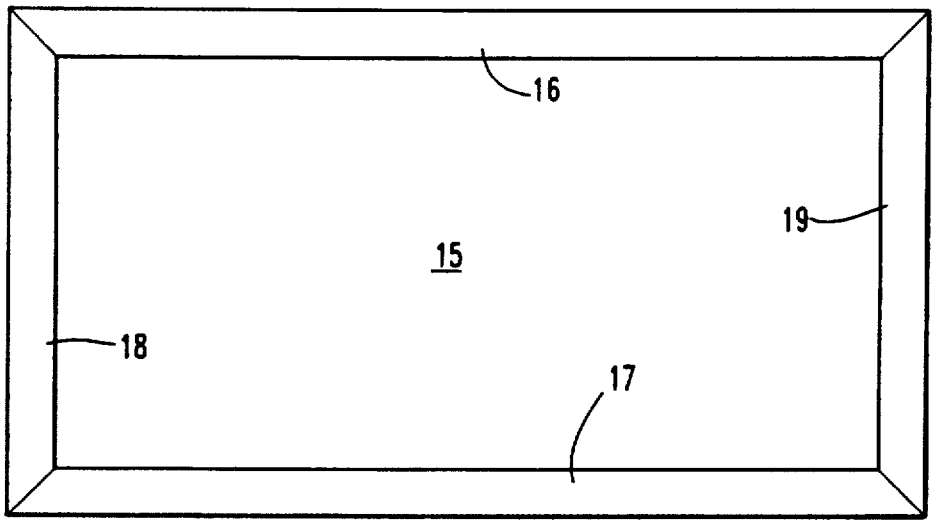
Figure 3:
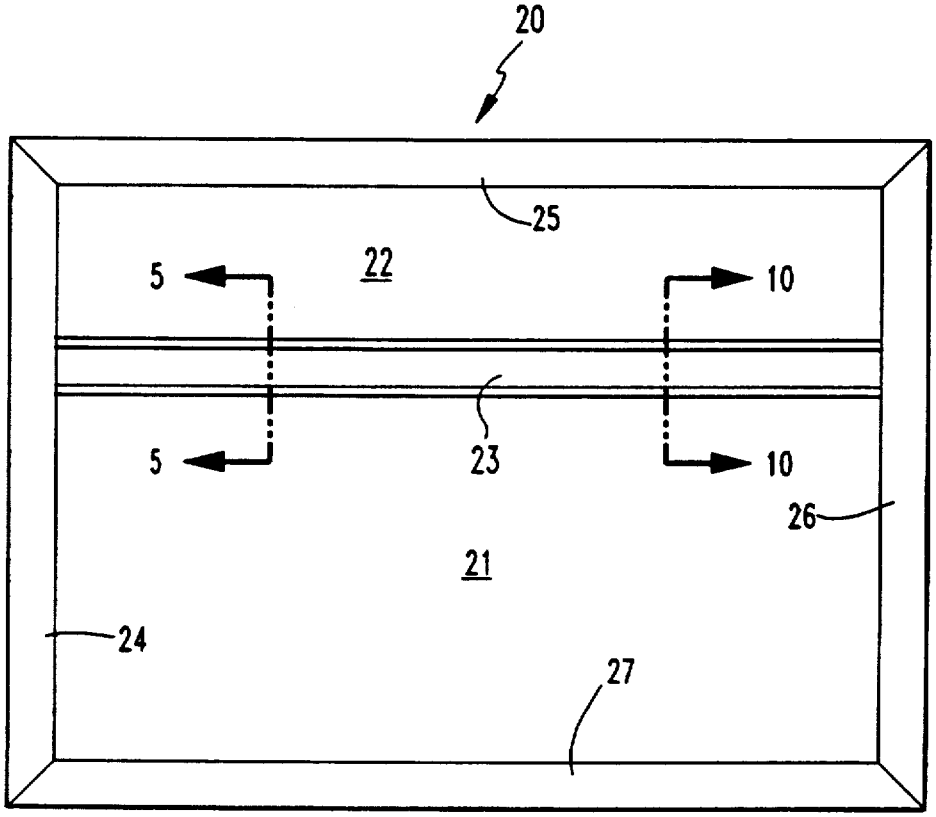

Referring now to the drawings in detail, FIGS. 1, 2, and 3 show representative examples of information display boards such as could either conventional trim mounting systems or the trim mounting system of the present invention. FIG. 1 shows a chalkboard 10 such as would typically be found in a classroom. The chalkboard 10 has a rectangular configuration and is bordered at its top and left and right sides by trim segments 11, 12, and 13, respectively, and at the bottom by a chalkboard tray 14. Although not shown, the trim segments 11-13 may be mitered at their respective junctures. FIG. 2 shows a tackboard 15 having mitered top, bottom and side trim segments 16-19, respectively. FIG. 3 shows another common exemplary display board 20. In this configuration, the display board 20 includes a lower chalkboard 21 and upper tackboard 22 divided by a trim segment 23 which is adapted for hanging thereon display maps and other like informational material. Trim segments 24-26 bound the sides and top of board 20 and a chalkboard tray 27 extends along the bottom margin. It should be understood that a dry markerboard could, for example, substitute for the chalkboard in FIGS. 1 and 3.

Figure 4:
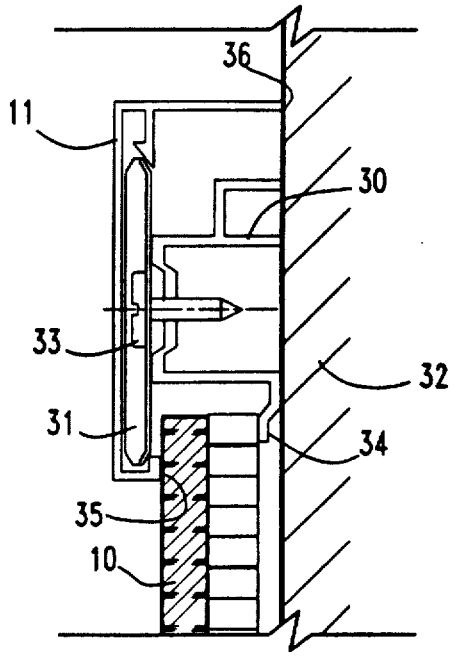
Fig. 4 Prior Art
FIG. 4 is a cross-section view taken along lines 4—4 in FIG. 1 showing a prior art trim mounting system.
Figure 5:
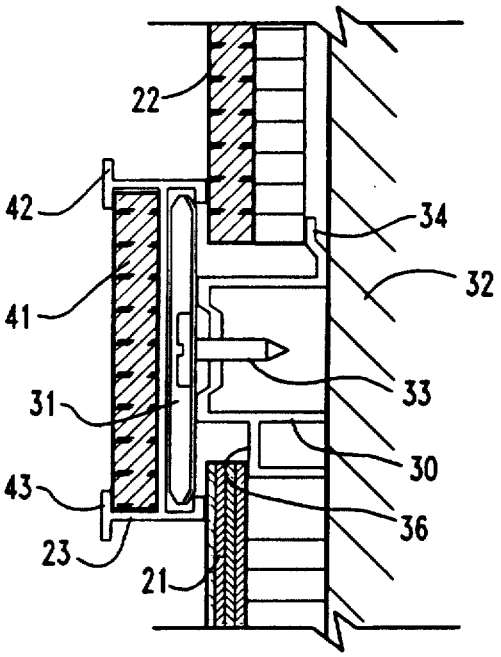
FIG. 5 is a cross-section view taken along lines 5—5 in FIG. 3 showing a prior art trim mounting system.

FIGS. 4 and 5 show examples of the use of the prior art trim mounting system with informational display boards of the type such as are exemplified in FIGS. 1-3. A detailed description of this prior art system is unnecessary as it is well known and understood to those persons skilled in the art. It should be noted that in FIGS. 4 and 5 common reference numerals are used to refer to identical elements. Referring first to FIG. 4, the trim mounting system is seen to include a ground 30, clip 31 and trim segment 11. Typically, the ground 30 will accommodate one wall mounting screw (not shown) which extends into wall 32 and a clip 31, although ground 30 is typically also a continuous strip which extends coterminously with the corresponding trim segment 11. If the ground 30 is not the type which extends coterminus with the trim segment 11, there will be a plurality of grounds 30 equally spaced apart as desired along the length of the trim segment. Clips 31 are secured to ground 30 by a screw 33. Although not shown, clip 31 is typically provided with an oblong mounting slot for receiving screw 33 which provides a lateral adjustment capability.

When in its mounted position, clip 31 overlies the margin of board 10 which is snugly received between it and lip 34. Ideally if the grounds 30 and clips 31 have been properly mounted and aligned, when trim segment 11 is snapped into position over clip 31, edge 35 will be flush against board 10 and edge 36 will be flush against the wall 32. Unfortunately, it is often very difficult and time consuming to achieve such a quality fit along the full length of the trim segments without dimpling the trim segments or otherwise marring the quality of the installation.

Referring now particularly to FIG. 5, there is shown another example of the prior art trim mounting system, here in a crossectional view taken along lines 5—5 in FIG. 3. In this example the ground 30 is shown mounted to wall 32 between chalkboard 21 and tackboard 22. It is noted that the different configuration and sizes of lips 34 and 36 serves to accommodate different standard thicknesses of boards 21 and 22. The installation of ground 30, clip 31 and trim segment 23 is the same as described in connection with FIG. 4. It is noted that the trim segment 23 shown here differs from that shown in FIG. 4 in that it includes a cork insert 41 and ears 42 and 43 which are shaped to receive corresponding standard mounting structure for hanging map displays, etc.

Figure 6:
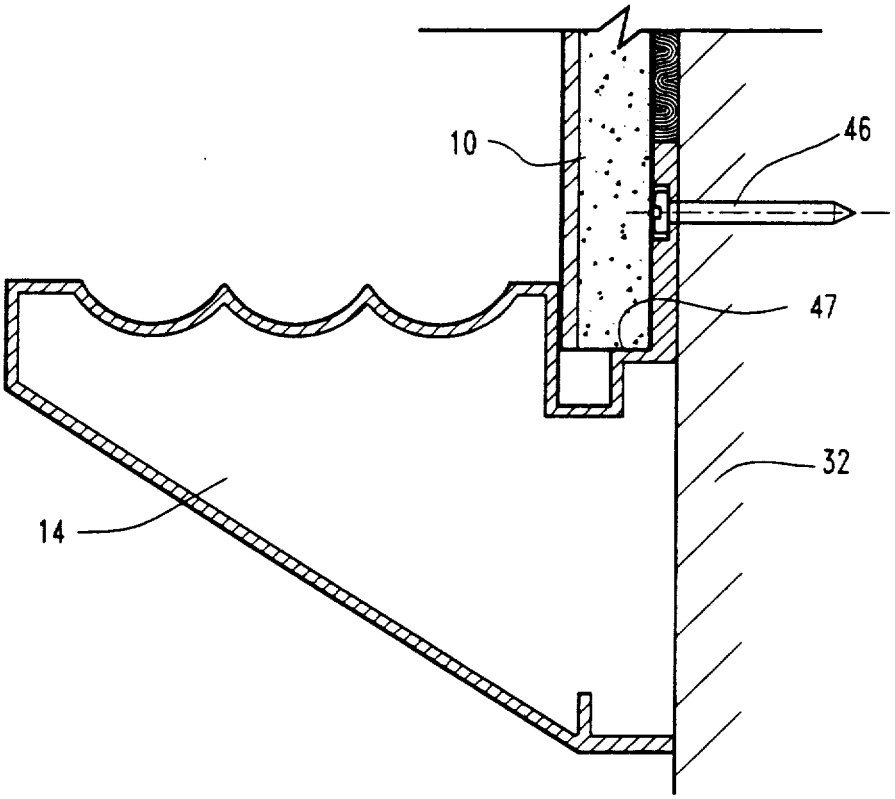
FIG. 6 is a cross-section view taken along lines 6—6 in FIG. 1 showing the mounting of the chalktray to the wall.

FIG. 6 shows a crossectional view of the chalkboard tray taken along lines 6—6 in FIG. 1. Chalk tray 14 is mounted to wall 32 by a plurality of mounting screws, bolts or tappet anchors such as shown at 46. Chalkboard 10 is supported in chalktray 14 within a recess 47. The trim installation system of the present invention may be employed with a chalktray mounted in this conventional fashion.

Figure 7:
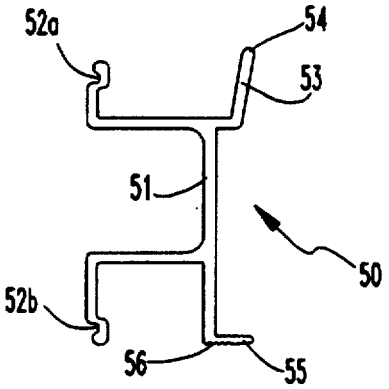
FIG. 7 is a cross-section view of the combination trim-mount/ground of the present invention.
Figure 15:
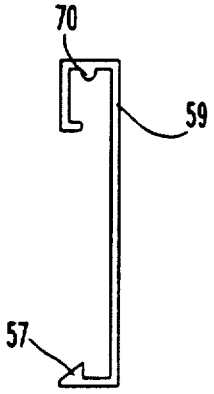
FIGS. 12-15 are cross-section views showing the trim segments depicted in FIGS. 8-11, respectively.
Figure 13:
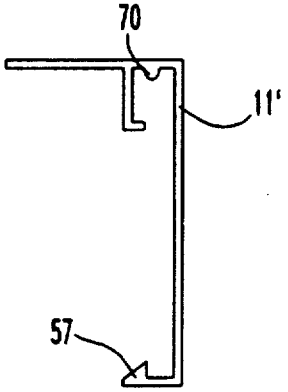
Figure 14:
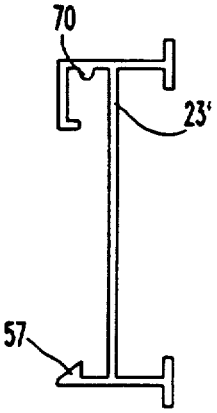
Figure 12:
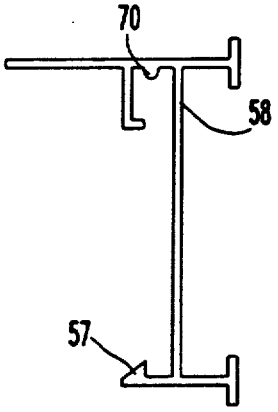

FIG. 7 shows a crossectional view of the one-piece, combination trim-mount/ground 50 of the present invention. Although shown in cross-section, it should be understood that trim-mount/ground 50 has an identical shape along its length and may be made by an extrusion. It should further be understood that the length of trim-mount/ground 50 will be cut or otherwise formed to correspond to the length of the trim segment to be mounted upon it. Trim-mount/ground 50 includes a central body portion 51 from which extend two lips 52*a* and 52*b*. The purpose of lips 52*a* and 52*b* is similar to the function of lip 34 of the prior art ground 30. Lip 52*a* is slightly shorter than lip 52*b* in order to facilitate the mounting of certain trim segments. Also extending from central body portion 51 is a trim mounting means for directly mounting a trim segment thereto. Surface 90 rests against the face of the display board to provide uniform fit of surface 61 to the board. The trim mounting means includes a flange 53 which extends from body portion 51 in a direction obliquely away from the display board to be mounted and functions as a hook to retain the trim segment to the trim-mount/ground 50. Towards the end thereof, the flange 53 has an abutment surface 54 for abuttingly engaging a trim segment in a manner as can seen in FIGS. 8-11. A round-shaped bead 70 extending along the length of the trim segment prevents edge 60 or leading surface 62 from being pulled away from the wall or display board surfaces, respectively. The trim mounting means further includes a bendable leg 55 extending from body portion 51 and having teeth or serrations 56 thereon. As also seen in FIGS. 8-11, the serrations 56 are adapted to interlockingly engage a resiliently flexible finger 57 which extends along the length of the variously configured trim segments which are adapted to mount to the trim-mount/ground 50.

Although not shown in FIG. 7, it should be appreciated that the trim-mount/ground 50 is provided with a plurality of pre-formed mounting holes at desired spaced intervals along the length of central body portion 51 for receiving therethrough wall fasteners such as shown in FIGS. 8–11. Preferably, these mounting holes are oblong slots which provide a degree of lateral adjustability in mounting to a wall.

Figure 8:
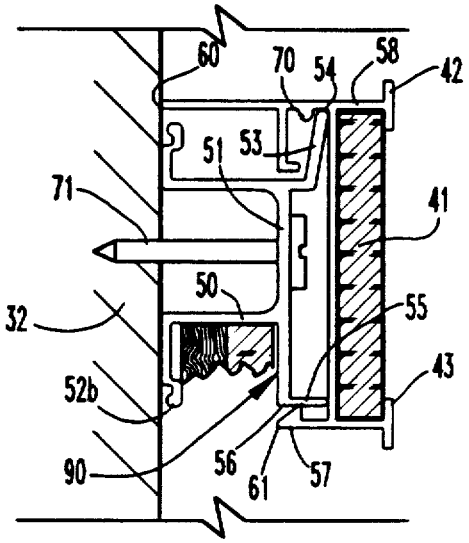
FIG. 8 is a cross-section view showing the mounting of an alternative top running trim segment to the trim-mount/ground of the present invention.

The trim-mount/ground 50 of the present invention can be used with any of the various exterior configurations of trim segments commonly used with the prior art trim mounting system. FIGS. 8–11 show cross-sectional views of the improved trim mounting system of the present invention in its mounted position on a wall with various types of trim segments mounted thereon, while FIGS. 12–15 show the trim segments by themselves. Where applicable, similar reference numerals have been used to describe similar elements in these figures. Each of the FIGS. 8–11 shows the mounting of trim-mount/-ground 50 to a wall, but with differently configured trim segments mounted thereon. The trim segment 58 shown in FIG. 8 is used as a top running trim segment only and has map display ears 42 and 43 similar to those shown in the prior art FIG. 5 as well as a cork insert 41. The trim segment 11' shown in FIG. 9 may be used for either the side or top borders of a display board while the trim segments 23' and 59, respectively, are divider segments for use between two display boards, such as is depicted in FIG. 3. The use of a prime after a reference numeral indicates that the element corresponds to a previously identically numbered element but is modified for use with the trim mounting system of the present invention.

Figure 9:
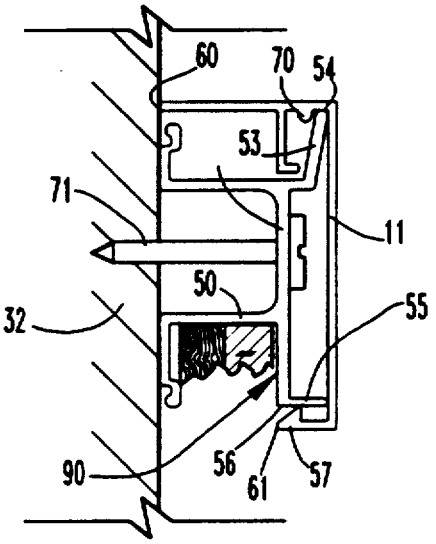
FIG. 9 is a cross-section view taken along lines 9—9 in FIG. 1 showing a side or top running trim segment mounted to the trim-mount/ground of the present invention.
Figure 10:
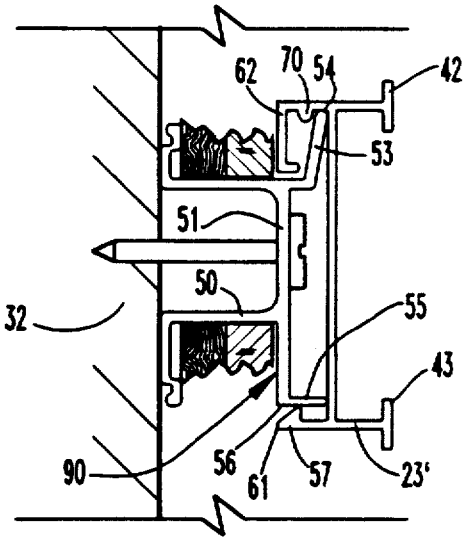
FIG. 10 is a cross-section view taken along lines 10—10 in FIG. 3 showing a divider trim segment mounted to the trim-mount/ground of the present invention.
Figure 11:
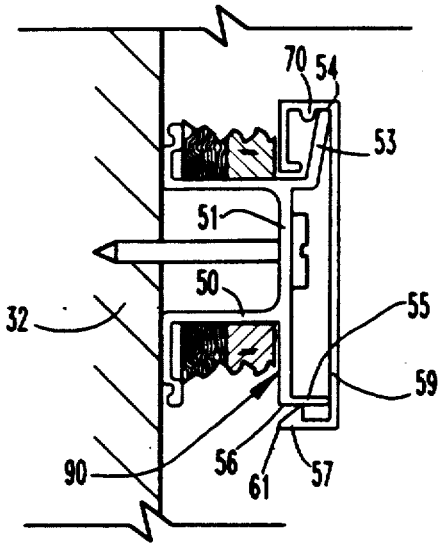
FIG. 11 is a cross-section view showing the mounting of an alternative divider trim segment to the trim-mount/ground of the present invention.

It should be noted in FIGS. 8–9 that each of the trim segments has an upper leading edge 60 which abuts the wall 32 and a lower leading edge 61 on finger 57 which abuts the display board when the trim segment is properly locked into position over trim-mount/ground 50 as shown. In similar fashion, the upper leading surface 62 and lower leading edge 61 on the trim segments of FIGS. 10 and 11 abut the upper and lower display boards. This quality trim fit is more easily accomplished using the trim-mount/grounds 50 of the present invention than with using prior art grounds and clips because the interlocking relationship between the finger 57 and the multiple serrations 56 on leg 55 allows for some variability in the advancement of the trim segment over the trim-mount/ground while still maintaining a positive locked in or snapped in orientation. In contrast, the trim segments merely snap into position over the prior art clips 31 and once snapped in may be loosely fitted to the display board or wall with no possibility of further adjustment.

The installation procedure for the trim mounting system of the present invention with an exemplary display board having a chalktray may be described as follows. The wall surface is checked for flatness and the areas required for shimming are marked. The chalktray is cut to the desired length and installed at the desired mounting height from the floor. Adhesive is applied between the chalkboard and the wall and the chalkboard is seated in position on the chalktray against the wall. A trim-mount/ground 50 is mounted to the wall along the top edge of the chalkboard, leaving ⅛" clearance between the ground 50 and the chalkboard. Trim-mount/grounds 50 are then mounted vertically into the wall along the sides of the chalkboard leaving ⅛" clearance between the grounds 50 and the chalkboard. Cut the desired trim segments to the desired lengths and install trim segments over grounds 50 by snapping therefore. If trim segments are too loose, bend the bendable leg 55 on grounds 50 to make small tabs at 12"–14" intervals to snap over.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A trim mounting system for mounting trim members to the margins of a wall mounted display board, comprising:

a plurality of trim members having lengths corresponding to said margins of said display board, each said trim member having an inner and an outer leading edge;

a plurality of combination trim-mount/grounds having lengths corresponding to said margins of said display board; and a trim mounting means, associated with each of said trim members and said trim-mount/grounds, for mounting said trim members directly to said trim-mount/grounds so that said inner leading edges of said trim members extend flush against the display board and said outer leading edges extend flush against one of either a second display board or the wall, said trim mounting means extending continuously along the length of said trim members and said trim-mount/grounds, each said trim-mount/ground having a body portion and said trim mounting means further including a bendable leg extending from said body portion, said leg extending continuously along the length of said trim-mount/ground and having serrations thereon, each said trim member further having a cover portion, said trim mounting means including a finger extending from said cover portion, said finger interlocking with said serrations on said bendable leg of said trim-mount/ground.

2. The trim mounting system of claim 1 wherein said trim mounting means further includes a hook flange integrally extending from said body portion in a direction obliquely away from the display board, said hook flange having an abutment surface for abuttingly engaging said trim member.

3. The trim mounting system of claim 2 wherein each said trim member includes a bead extending inwardly along the length of said trim member, said abutment surface of said hook flange being received between said bead and said cover portion of said trim member and preventing said outer leading edge of said trim member from being pulled away from said wall.

4. The trim mounting system of claim 3 wherein said trim-mount/grounds and said trim members are adapted to mount together such that said hook flanges and the cover portion of said trim members lie in planes forming an acute angle therebetween.

5. The trim mounting system of claim 4 wherein said trim-mount/grounds and said trim members are each extruded metal formed and of unitary construction.

* * * * *

UNITED STATES PATENT AND TRADEMARK OFFICE

CERTIFICATE OF CORRECTION

PATENT NO. : 5,220,763

DATED : June 22, 1993

INVENTOR(S) : Dwight M. Armitage

It is certified that error appears in the above-indentified patent and that said Letters Patent is hereby corrected as shown below:

Col. 1, line 21, insert --the-- after "framing".

Col. 1, line 60, change "board" to --boards--.

Col. 1, line 63, change "trim/mount grounds" to --trim-mount/grounds--.

Col. 2, line 21, insert --extruded-- before "formed".

Col. 2, line 49, change "chalk/" to --chalkboard--.

Col. 6, line 5, change "therefore" to --thereover--.

Signed and Sealed this

Fourteenth Day of March, 1995

*Attest:*

*Attesting Officer*

Bruce Lehman

BRUCE LEHMAN

*Commissioner of Patents and Trademarks*